US005228828A

United States Patent [19]

Damlis et al.

[11] Patent Number: 5,228,828

[45] Date of Patent: Jul. 20, 1993

[54] GAS TURBINE ENGINE CLEARANCE CONTROL APPARATUS

[75] Inventors: Nicholas Damlis; Frederick J. Zegarski, both of Cincinnati; Donald D. Brayton, Maineville, all of Ohio

[73] Assignee: General Electric Company, Cincinnati, Ohio

[21] Appl. No.: 656,275

[22] Filed: Feb. 15, 1991

[51] Int. Cl.[5] ..... F01D 11/08

[52] U.S. Cl. ..... 415/173.20; 415/173.3

[58] Field of Search ..... 415/173.1, 173.2, 173.3, 415/174.2

[56] References Cited

U.S. PATENT DOCUMENTS

| | | | |
|---|---|---|---|
| 2,068,470 | 8/1981 | Coplin . | |
| 2,199,664 | 7/1988 | Stowell . | |
| 3,039,737 | 6/1962 | Kolthoff . | |
| 3,062,497 | 11/1962 | Howes et al. . | |
| 3,085,398 | 4/1963 | Ingleson . | |
| 3,520,635 | 7/1970 | Killmann et al. . | |
| 3,623,736 | 11/1971 | Petrie et al. . | |
| 3,966,354 | 6/1976 | Patterson . | |
| 4,005,946 | 2/1977 | Brown et al. . | |
| 4,050,843 | 9/1977 | Needham et al. . | |
| 4,127,357 | 11/1978 | Patterson | 415/173.1 |
| 4,230,436 | 10/1980 | Davison . | |
| 4,264,274 | 4/1981 | Benedict . | |
| 4,330,234 | 5/1982 | Colley . | |
| 4,332,523 | 6/1982 | Smith . | |
| 4,343,592 | 10/1982 | May . | |
| 4,384,819 | 5/1983 | Baker . | |
| 4,419,044 | 12/1983 | Barry et al. . | |
| 4,632,635 | 12/1986 | Thoman et al. . | |
| 4,657,479 | 4/1987 | Brown et al. . | |
| 4,683,716 | 8/1987 | Wright et al. . | |
| 4,714,404 | 12/1987 | Lardellier . | |
| 4,773,817 | 9/1988 | Stangalini et al. . | |
| 5,018,942 | 5/1991 | Ciokajlo et al. | 415/173.2 |
| 5,056,988 | 10/1991 | Corsmeier et al. | 415/126 |

OTHER PUBLICATIONS

Sketch, F. Zegarski, "Advanced High Work Turbine, Phase I", Apr. 6, 1988, meeting at Wright-Patterson Air Force Base on Apr. 6, 1988.

E. J. Kawecki, Pratt & Whitney, "Thermal Response Turbine Shroud Study", pp. 5, 6, 8-18, 28-33, 66-82 and 88-91, dated Jul. 1979.

*Primary Examiner*—Edward K. Look

*Assistant Examiner*—James A. Larson

*Attorney, Agent, or Firm*—Douglas E. Erickson; Jerome C. Squillaro

[57] ABSTRACT

Apparatus for controlling the clearance between the tips of a row of rotor blades and an array of surrounding shroud segments in a gas turbine engine. A torque tube is rotatably mounted on the engine casing and has a cam positioned inside the casing. First and second members are positioned inside the casing so as to be only axially moveable and so as to have their cam-engaging surfaces axially surround the cam, and they are biased such that the cam-engaging surfaces engage the cam. A shroud hanger, to which a shroud segment may be attached, includes axially spaced apart hooked flanges positioned to be engaged by hooked flanges of the first and second members. The flanges have axially inclined slide surfaces for such engagement, and the shroud hanger is biased radially inward to engage such slide surfaces. Clearance is controlled by rotation of the torque tube which axially moves the first and second members which radially moves the shroud segment.

2 Claims, 3 Drawing Sheets

GAS TURBINE ENGINE CLEARANCE CONTROL APPARATUS

The U.S. Government has rights in this invention pursuant to Contract No. F33615-87-C-2764 between the U.S. Air Force and the General Electric Company.

CROSS-REFERENCE TO RELATED APPLICATIONS

Reference is hereby made to the following copending applications dealing with related subject matter and assigned to the assignee of the present invention:

1. "Blade Tip Clearance Control Apparatus Using Bellcrank Mechanism" by Robert J. Corsmeier et al, filed Nov. 22, 1989, and assigned U.S. Ser. No. 07/440,633, U.S. Pat. No. 5,054,997.
2. "Blade Tip Clearance Control Apparatus For A Gas Turbine Engine", by John J. Ciokajlo, filed Sep. 8, 1989, and assigned U.S. Ser. No. 07/405,369, U.S. Pat. No. 5,104,287.
3. "Mechanical Blade Tip Clearance Control Apparatus For A Gas Turbine Engine", by John J. Ciokajlo et al, filed Sep. 8, 1989, and assigned U.S. Ser. No. 07/404,923, U.S. Pat. No. 5,018,942.
4. "Radial Adjustment Mechanism For Blade Tip Clearance Control Apparatus", by John J. Ciokajlo, filed Sep. 8, 1989, and assigned U.S. Ser. No. 07/405,374, U.S. Pat. No. 5,096,375.
5. "Blade Tip Clearance Control Apparatus Using Shroud Segment Position Modulation", by Robert J. Corsmeier et al, filed Feb. 12, 1990, and assigned U.S. Ser. No. 07/480,198, U.S. Pat. No. 5,056,988.
6. "Blade Tip Clearance Control Apparatus With Shroud Segment Position Adjustment By Unison Ring Movement", by Wu-Yang Tseng et al, filed Mar. 21, 1990, and assigned U.S. Ser. No. 07/507,428, U.S. Pat. No. 5,035,573.
7. "Blade Tip Clearance Control Apparatus Using Cam-Actuated Shroud Segment Positioning Mechanism", by Robert J. Corsmeier et al, filed Feb. 20, 1990, and assigned U.S. Ser. No. 07/482,139, U.S. Pat. No. 5,049,033.

BACKGROUND OF THE INVENTION

The present invention relates generally to gas turbine engines, and more particularly to a mechanical apparatus for controlling the clearance between a row of rotor blade tips and a surrounding shroud in a gas turbine engine.

A gas turbine engine includes a rotary compressor to compress the air flow entering the engine, a combustor in which a mixture of fuel and the compressed air is burned to generate a propulsive gas flow, and a turbine which is rotated by the propulsive gas flow and which is connected by a shaft to drive the compressor. The efficiency of a gas turbine engine, such as an aircraft jet engine, depends in part on the clearance or gap between the rotor blade tips and the surrounding engine casing shroud, such as the clearance between the engine's turbine blades and the engine's turbine casing and the clearance between the engine's compressor blades and the engine's compressor casing. If the clearance is too large, more of the engine air flow will leak through the gap between the rotor blade tips and the surrounding shroud, decreasing the engine's efficiency. If the clearance is too small, the rotor blade tips may strike the surrounding shroud during certain engine operating conditions.

It is known that the clearance changes during engine acceleration or deceleration due to changing centrifugal force on the blade tips and due to relative thermal growth between the rotor and the engine casing. For instance, upon engine acceleration, the thermal expansion of the rotor typically lags that of the engine casing, and upon engine deceleration, the engine casing contracts more rapidly than does the rotor.

Control mechanisms, usually of the mechanical or thermal type, have been proposed in the prior art to maintain a generally constant rotor-to-shroud clearance despite changing engine operating conditions. However, none are believed to represent the optimum design for controlling such clearance. Consequently, a need still remains for an improved apparatus for clearance control, one that will maintain a minimum clearance between the rotor blade tips and the engine casing shroud throughout the operating range of the engine and thereby improve engine efficiency by achieving more thrust with less fuel.

SUMMARY OF THE INVENTION

It is an object of the invention to provide an improved mechanical apparatus for controlling the clearance between a gas turbine engine's rotor blades and its surrounding engine casing shroud.

The invention provides an apparatus for controlling the clearance between the tips of a row of rotor blades and an array of surrounding shroud segments in a gas turbine engine. The apparatus includes a torque tube rotatably mounted on the engine casing and having a cam positioned inside the casing. First and second members are positioned inside the casing so as to be only axially moveable and so as to have their cam-engaging surfaces axially surround the cam, and they are biased such that the cam-engaging surfaces engage the cam. A shroud hanger, to which a shroud segment may be attached, includes axially spaced apart hooked flanges positioned to be engaged by hooked flanges of the first and second members. The flanges have axially inclined slide surfaces for such engagement, and the shroud hanger is biased radially inward to engage such slide surfaces. Clearance is controlled by rotation of the torque tube which axially moves the first and second members which radially moves the shroud segment.

Several benefits and advantages are derived from the clearance control apparatus of the invention. The torque tube of the invention is capable of rapidly adjusting the clearance gap. The absence of any threaded arrangement in the apparatus reduces the need for machining of parts. The apparatus is "fail safe" in that if torque is removed from the torque tube, the apparatus will maximize the clearance to avoid any possibility of the rotor blade tips striking the surrounding shroud during any engine operating condition.

BRIEF DESCRIPTION OF THE DRAWINGS

The accompanying drawings illustrate several preferred embodiments of the present invention wherein.

DETAILED DESCRIPTION OF THE INVENTION

Figure 1:
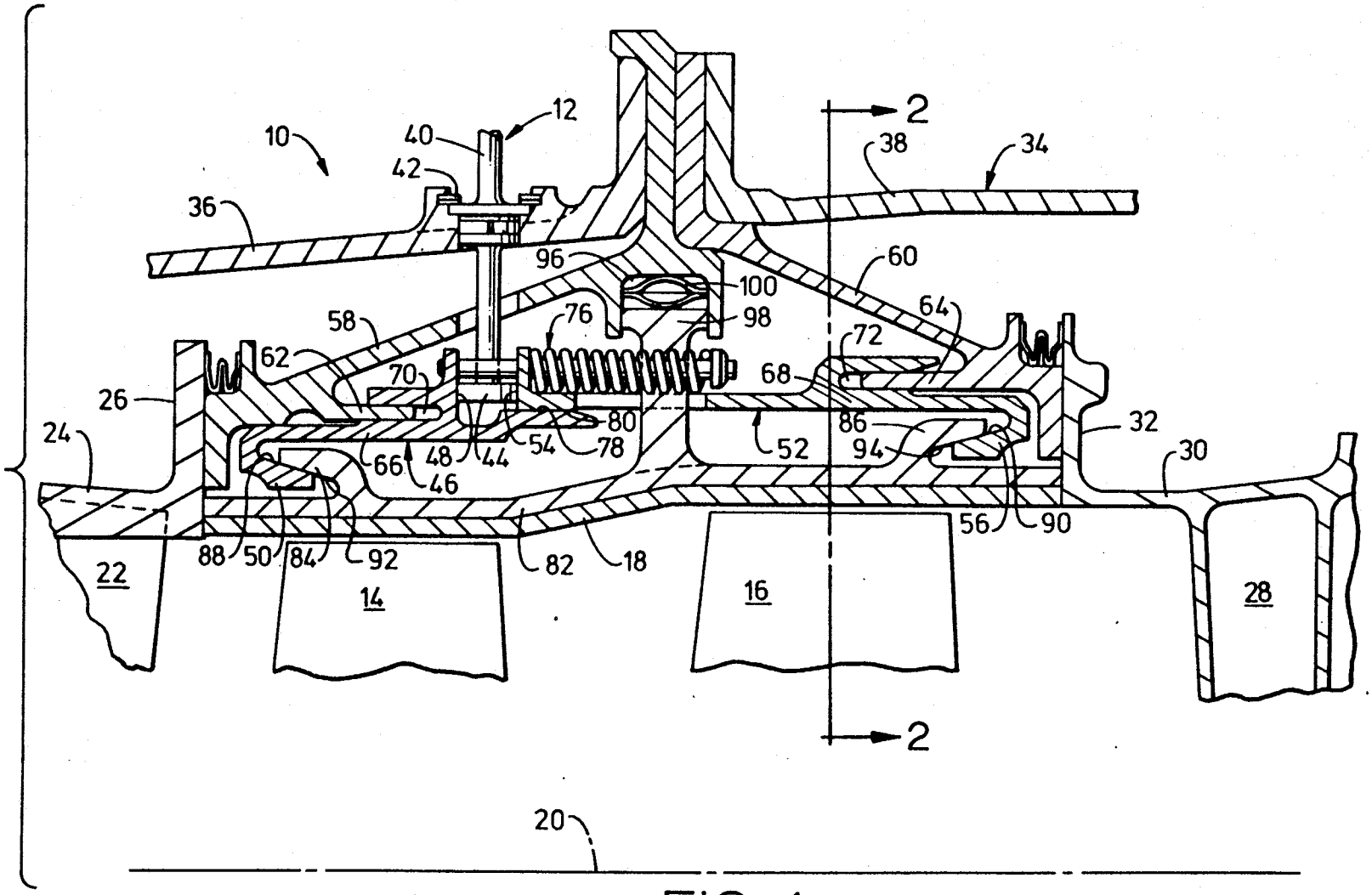
FIG. 1 is a schematic view of a portion of a gas turbine engine disclosing a preferred embodiment of the clearance control apparatus of the invention.
Figure 2:
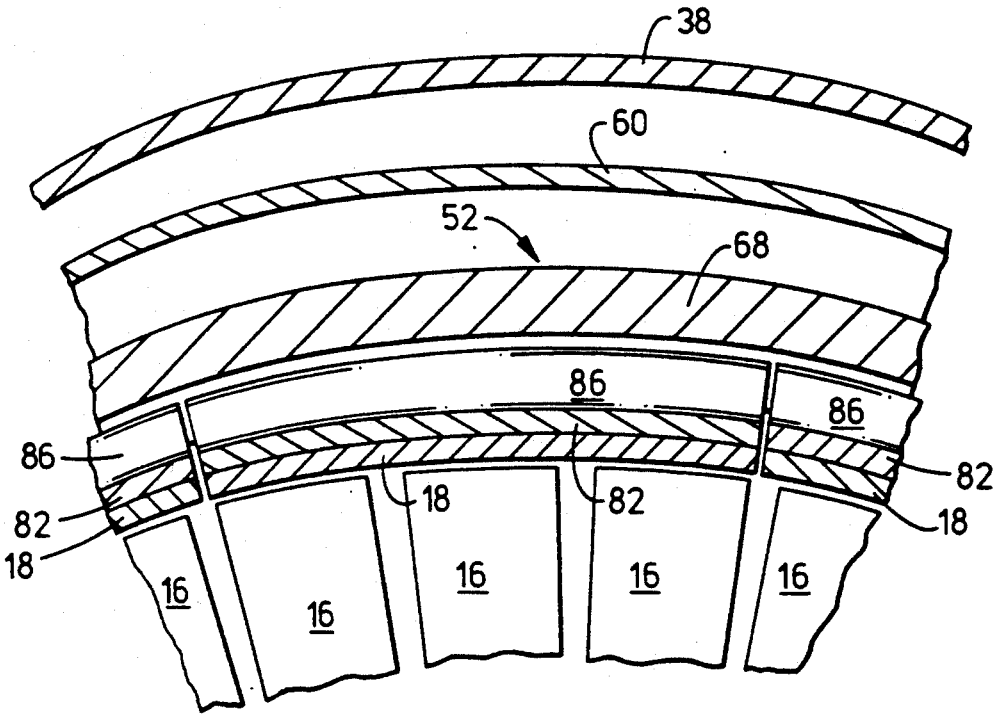
FIG. 2 is a sectional view of the gas turbine engine portion of FIG. 1 taken along lines 2—2 of FIG. 1.
Figure 3:
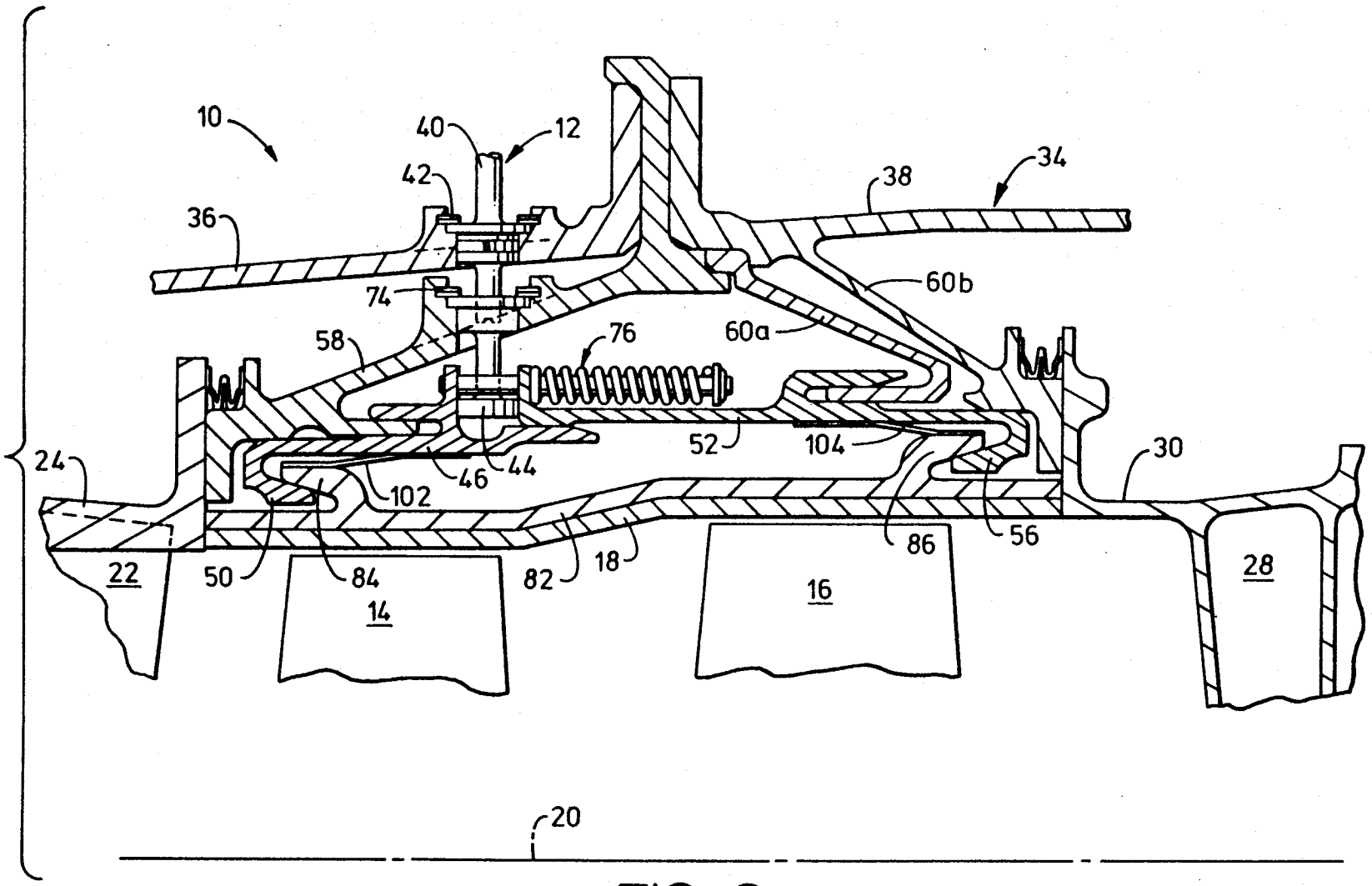
FIG. 3 is a schematic view of a portion of a gas turbine engine disclosing another preferred embodiment of the clearance control apparatus of the invention.

FIGS. 1, 2, and 3 show a portion of a gas turbine engine 10 employing a first preferred embodiment (FIGS. 1 and 2) and a second preferred embodiment (FIG. 3) of the clearance control apparatus 12 of the invention. The apparatus 12 is used for controlling the clearance between the tips of two rows of radially outwardly extending rotor blades 14 and 16 and an annular array of circumferentially surrounding shroud segments 18. The rotor blades 14 are connected to a high pressure (HP) turbine rotor (not shown), and the rotor blades 16 are connected to a counterrotating low pressure (LP) turbine rotor (not shown). The blades 14 and 16 rotate about the axially (longitudinally) extending centerline 20 of the engine 10. Upstream of the HP turbine rotor blades 14 are turbine nozzle stator vanes 22 which are connected to a combustor inner case 24 which terminates downstream in a radially outward extending flange 26, and downstream of the LP turbine rotor blades 16 are turbine frame struts 28 which are integral with a turbine inner case 30 which terminates upstream in a radially outward extending flange 32. Radially outermost of the HP and LP turbine rotor blades 14 and 16 is a generally axially extending engine casing 34 having a combustor outer casing portion 36 and a turbine outer casing portion 38.

The clearance control apparatus 12 includes a radially extending torque tube 40 rotatably mounted on the combustor outer casing portion 36 of the engine casing 34 by snap rings 42. The torque tube 40 has an axially extending cam 44 which is disposed inside the engine casing 34. The clearance control apparatus 12 also includes a first member 46 having a first cam-engaging surface 48 and a first hooked flange 50 and further includes a second member 52 having a second cam-engaging surface 54 and a second hooked flange 56. The first and second members 46 and 52 preferably are annular in shape.

Means are employed for disposing the first and second members 46 and 52 inside the engine casing 34 such that the members 46 and 52 are generally only axially moveable relative to the engine casing 34 and such that the cam-engaging surfaces 48 and 54 axially surround the cam 44. Preferably, the disposing means includes first and second support cones 58 and 60 each fixedly attached to the engine casing 34 and each having an axially extending circumferential rim 62 and 64, and the disposing means further includes the first and second members 46 and 52 each having a circumferentially continuous ring portion 66 and 68 each with an axially extending circumferential groove 70 and 72 slidably engaging a corresponding rim 62 or 64. Other disposing means include conventional axial sliding engagements between the members 46 and 52 and structures attached to, or integral with, the flanges 26 and 32 of the combustor and turbine inner cases 24 and 30 or attached to, or integral with, the engine casing 34, and the like. It is noted in the second preferred embodiment, as seen in FIG. 3, that the torque tube 40 may also be rotatably attached to the first support cone 58 by additional snap rings 74, and it is noted in both preferred embodiments that the cam 44 is disposed inside the first support cone 58.

Means also are employed for biasing the first and second members 46 and 52 such that their cam-engaging surfaces 48 and 54 are axially engaged by the cam 44. Preferably such member-biasing means includes a spring, such as a spring plunger 76 interconnecting the first and second members 46 and 52. When the spring plunger 76 is employed, the previously-discussed disposing means preferably additionally includes the members 46 and 52 having axially engagable glide surfaces 78 and 80. Other member-biasing means include springs which are supported by the support cones 58 and 60 and push against the members 46 and 52, a single spring attached to and pulling together the members 46 and 52, and the like.

The clearance control apparatus 12 further includes a plurality of shroud hangers 82, with a shroud segment 18 being attachable to a corresponding shroud hanger 82. As best seen in FIG. 2, the shroud hangers 82 each comprise a circumferential segment and together comprise an annular array. As best seen in FIG. 1, a shroud hanger 82 has axially spaced apart third and fourth hooked flanges 84 and 86 disposed to be engagable respectively by the first and second hooked flanges 50 and 56. The flanges 50, 56, 84, and 86 are seen to have axially inclined slide surfaces 88, 90, 92, and 94 for such engagement. In an exemplary embodiment, the first and second hooked flanges 50 and 56 axially face toward each other, and the third and fourth hooked flanges 84 and 86 axially face away from each other wherein the slide surfaces 88 and 90 of the first and second hooked flanges 50 and 56 radially face outward and the slide surfaces 92 and 94 of the third and fourth hooked flanges 84 and 86 radially face inward.

Means additionally are employed for biasing each of the shroud hangers 82 radially inward to engage the slide surfaces. Preferably such shroud-hanger-biasing means includes a spring. In the first preferred embodiment of the clearance control apparatus 12 shown in FIG. 1, the first support cone 58 also has a radially inwardly extending cavity 96, the shroud hanger 82 also includes a radially outwardly projecting portion 98 disposed generally midway between the shroud hanger's axial ends and engaging the cavity 96, and the shroud-hanger-biasing means includes a coned disc spring 100 disposed in the cavity 96 to push against the shroud hanger's projecting portion 98. In the second preferred embodiment of the clearance control apparatus 12 shown in FIG. 3, the shroud-hanger-biasing means includes a leaf spring 102 having one end attached to the third hooked flange 84 and having another end compressibly and slidably contacting the first member 46 and a leaf spring 104 having one end attached to the fourth hooked flange 86 and having another end compressibly and slidably contacting the second member 52.

In operation, rotation of the torque tube 40 axially moves the first and second members 46 and 52, through the action of the cam 44, which radially moves the shroud hanger 82 and its attached shroud segments 18, through action of the slide surfaces 88, 90, 92, and 94. The mechanism to rotate the torque tube 40 as well as the control logic to determine the desired angular position of the torque tube 40 at any given time during operation of the gas turbine engine 10 are well known to those skilled in the art. For example, a unison ring could be employed to rotate the torque tube 40 in the same manner a unison ring is used to rotate a variable compressor stator vane in an aircraft gas turbine engine.

Likewise, an engine control computer employed to provide, among other things, the control logic to the unison ring in rotating the aircraft engine's variable stator vanes could also be employed to provide the control logic to the same or another unison ring in rotating the torque tube 40. Various algorithms for the torque tube control logic may be used. In one method, proximity sensors may be employed to measure the clearance, and feedback control system logic may be used to keep the clearance constant under varying engine operating conditions. In another method, the torque tube 40 may be directly driven to empirically predetermined angular positions based on engine test results obtained for various engine operating conditions. Again, such methods are known to those skilled in the art and do not form any part of the present invention.

Given the above description, one of ordinary skill in the art can employ the clearance control apparatus 12 of the invention to satisfy the clearance requirements a particular gas turbine engine application. It is understood that the clearance control apparatus invention is not limited to aircraft jet engines but may be incorporated into other gas turbine engines such as those used in electric power generation, ship propulsion, and oil and gas pipeline pumping installations and the like.

In the broadest form of the invention, the turbine rotor blades 14 and 16 of the drawings can be replaced with fan, booster, compressor or other turbine rotor blades and the like. The invention may be employed for a single row of rotor blades as well as for two or more rows or rotor blades rotating in the same or counterrotating directions with or without intervening rows of stator vanes connected to the shroud segments, shroud hangers, or inner casings and the like. Also, obvious changes in the structural elements of the clearance control apparatus 12 may be made without departing from the invention, such as replacing the second support cone 60 of FIG. 1 with the two support cones 60*a* and 60*b* of FIG. 3.

The foregoing description of several preferred embodiments of the invention has been presented for purposes of illustration. It is not intended to be exhaustive or to limit the invention to the precise form disclosed, and obviously many modifications and variations are possible in light of the above teachings all of which are within the scope of the claims appended hereto.

We claim:

1. An apparatus for controlling the clearance between the tips of a row of radially outwardly extending rotor blades and an annular array of circumferentially surrounding shroud segments in a gas turbine engine having a generally axially extending engine casing, said apparatus comprising:

(a) a radially extending torque tube rotatably mounted on said casing and having an axially extending cam disposed inside said casing;

(b) a first member having a first cam-engaging surface and a first hooked flange;

(c) a second member having a second cam-engaging surface and a second hooked flange;

(d) means for disposing said members inside said casing such that said members are generally only axially moveable relative to said casing and such that said cam-engaging surfaces axially surround said cam;

(e) means for biasing said members such that said cam-engaging surfaces axially engage said cam;

(f) a shroud hanger having axially spaced apart third and fourth hooked flanges disposed to be engagable respectively by said first and second hooked flanges, said flanges having axially inclined slide surfaces for said engagement, and with a said shroud segment attachable to said shroud hanger; and (g) means for biasing said shroud hanger radially inward to engage said slide surfaces, wherein rotation of said torque tube axially moves said first and second members which radially moves said shroud segment;

wherein said disposing means includes a support cone fixedly attached to said casing and having an axially extending circumferential rim and wherein said disposing means also includes one of said members having a circumferentially continuous ring portion with an axially extending circumferential groove slidably engaging said rim, and wherein said torque tube is also rotatably attached to said support cone and said cam is also disposed inside said support cone.

2. An apparatus for controlling the clearance between the tips of a row of radially outwardly extending rotor blades and an annular array of circumferentially surrounding shroud segments in a gas turbine engine having a generally axially extending engine casing, said apparatus comprising:

(a) a radially extending torque tube rotatably mounted on said casing and having an axially extending cam disposed inside said casing;

(b) a first member having a first cam-engaging surface and a first hooked flange;

(c) a second member having a second cam-engaging surface and a second hooked flange;

(d) means for disposing said members inside said casing such that said members are generally only axially moveable relative to said casing and such that said cam-engaging surfaces axially surround said cam;

(e) means for biasing said members such that said cam-engaging surfaces axially engage said cam;

(f) a shroud hanger having axially spaced apart third and fourth hooked flanges disposed to be engagable respectively by said first and second hooked flanges, said flanges having axially inclined slide surfaces for said engagement, and with a said shroud segment attachable to said shroud hanger; and (g) means for biasing said shroud hanger radially inward to engage said slide surfaces, wherein rotation of said torque tube axially moves said first and second members which radially moves said shroud segment;

wherein said disposing means includes a support cone fixedly attached to said casing and having an axially extending circumferential rim and wherein said disposing means also includes one of said members having a circumferentially continuous ring portion with an axially extending circumferential groove slidably engaging said rim, and wherein said means for biasing said shroud hanger includes a leaf spring having one end attached to said third hooked flange and having another end compressibly and slidably contacting said first member.

* * * * *